US008397496B2

(12) United States Patent
Frank

(10) Patent No.: US 8,397,496 B2
(45) Date of Patent: Mar. 19, 2013

(54) BUOYANCY ENGINE USING A SEGMENTED CHAIN

(76) Inventor: Joshua W Frank, Sedona, AZ (US)

( * ) Notice: Subject to any disclaimer, the term of this patent is extended or adjusted under 35 U.S.C. 154(b) by 515 days.

(21) Appl. No.: 12/338,741

(22) Filed: Dec. 18, 2008

(65) Prior Publication Data

US 2010/0154405 A1 Jun. 24, 2010

(51) Int. Cl.
*F03C 1/00* (2006.01)

(52) U.S. Cl. ..... 60/496; 60/495

(58) Field of Classification Search ..... 60/495–496
See application file for complete search history.

(56) References Cited

U.S. PATENT DOCUMENTS

| | | | | |
|---|---|---|---|---|
| 322,785 | A | | 7/1885 | Bradway |
| 1,708,807 | A | | 4/1929 | Tatay |
| 2,037,973 | A | | 4/1936 | Grondahl |
| 2,135,110 | A | | 11/1938 | Platt |
| 2,513,136 | A | | 6/1950 | Borsos |
| 3,194,008 | A | | 7/1965 | Baumgartner |
| 3,412,482 | A | | 11/1968 | Kusmer |
| 3,857,242 | A | | 12/1974 | Gilmore |
| 3,934,964 | A | | 1/1976 | Diamond |
| 3,984,698 | A | | 10/1976 | Brewer |
| 4,038,826 | A | * | 8/1977 | Shaw ..... 60/641.14 |
| 4,054,031 | A | | 10/1977 | Johnson |
| 4,084,375 | A | | 4/1978 | Horvath |
| 4,135,364 | A | | 1/1979 | Busick |
| 4,242,868 | A | | 1/1981 | Smith |
| 4,254,622 | A | | 3/1981 | Denson, Sr. |
| 4,317,046 | A | | 2/1982 | Holmberg |
| 4,325,216 | A | * | 4/1982 | Mermis ..... 60/496 |
| 4,326,132 | A | | 4/1982 | Bokel |
| 4,363,212 | A | | 12/1982 | Everett |
| 4,392,062 | A | | 7/1983 | Bervig |
| 4,425,510 | A | | 1/1984 | Jury |
| 4,466,244 | A | | 8/1984 | Wu |
| 4,472,937 | A | | 9/1984 | Isamu |
| 4,498,294 | A | * | 2/1985 | Everett ..... 60/496 |
| 4,538,415 | A | | 9/1985 | Lebecque |
| 4,674,281 | A | | 6/1987 | Kim et al. |
| 4,718,232 | A | | 1/1988 | Willmouth |
| 4,726,188 | A | | 2/1988 | Woolfolk |
| 4,742,242 | A | | 5/1988 | De Shon |
| 4,865,723 | A | | 9/1989 | De Shon |
| 5,291,847 | A | | 3/1994 | Webb |
| 5,426,332 | A | | 6/1995 | Ullman |
| 5,430,333 | A | | 7/1995 | Binford et al. |
| 5,552,657 | A | | 9/1996 | Epstein et al. |
| 5,555,728 | A | * | 9/1996 | Welch, Jr. ..... 60/496 |
| 5,578,889 | A | | 11/1996 | Epstein |
| 5,753,978 | A | | 5/1998 | Lee |
| 5,889,336 | A | | 3/1999 | Tateishi |
| 5,905,312 | A | | 5/1999 | Liou |
| 5,944,480 | A | | 8/1999 | Forrest |
| 5,996,344 | A | | 12/1999 | Frenette et al. |
| 6,009,707 | A | | 1/2000 | Alkhamis |

(Continued)

*Primary Examiner* — Hoang Nguyen
(74) *Attorney, Agent, or Firm* — Snell & Wilmer LLP

(57) ABSTRACT

In accordance with various aspects of the present invention, a method and system for a buoyancy engine is presented. In an exemplary embodiment, the buoyancy engine includes a divider to separate a liquid environment from a gas environment, and a reservoir aperture in the divider. A rotating element, approximately opposite the reservoir aperture, provides tension to, and helps rotate, a segmented chain. The segmented chain is configured to form a solid inner surface when transitioning between the liquid and gas environments, but separate during vertical travel. As the segmented chain travels between the liquid and gas environments, a rotary motion is created which can be captured as electrical or mechanical energy.

17 Claims, 16 Drawing Sheets

U.S. PATENT DOCUMENTS

| | | | |
|---|---|---|---|
| 6,115,950 | A | 9/2000 | Al-Mutairi |
| 6,249,057 | B1 | 6/2001 | Lehet |
| 6,305,165 | B1 | 10/2001 | Mitzuki, Sr. |
| 6,546,726 | B1 | 4/2003 | Tomoiu |
| 6,734,574 | B2 | 5/2004 | Shin |
| 6,800,954 | B1 | 10/2004 | Meano |
| 6,930,406 | B2 | 8/2005 | Montgomery |
| 7,059,123 | B2 | 6/2006 | Welch, Jr. et al. |
| 7,078,827 | B2 | 7/2006 | Brewington |
| 7,134,283 | B2 | 11/2006 | Villalobos |
| 7,199,483 | B2 | 4/2007 | Lomerson, Sr. et al. |
| 7,257,946 | B2 | 8/2007 | Welch, Jr. |
| 7,258,532 | B2 | 8/2007 | Welch, Jr. et al. |
| 7,331,174 | B2 | 2/2008 | Welch, Jr. et al. |
| 2007/0183912 | A1 | 8/2007 | Lopez |

* cited by examiner

140

140

BUOYANCY ENGINE USING A SEGMENTED CHAIN

FIELD OF INVENTION

The present invention relates to a mechanical buoyancy engine. More particularly, the invention relates to the structure and operation of a segmented chain in a buoyancy engine.

BACKGROUND OF THE INVENTION

A buoyancy engine is a highly efficient means of generating energy using the natural buoyancy effect of various materials in a soluble solution to create a rotary motion. A buoyancy engine is a well known idea and various attempts to create an efficient buoyancy engine have been attempted. However, disadvantages exist with the typical buoyancy engine. For example, components attempting to enter towards the bottom of a liquid environment are subject to an outward pressure. Generally, extra components or devices are added to create a counter force or lessen the liquid's outward pressure. However, extra components and/or devices add cost to the system and require maintenance or replacement. Thus, a need exists for a simple buoyancy engine capable of efficiently generating energy with a minimal assembly of components.

SUMMARY OF THE INVENTION

In accordance with various aspects of the present invention, a method and system for a buoyancy engine is presented. In an exemplary embodiment, the buoyancy engine includes a divider to separate a liquid environment from a gas environment, and a reservoir aperture in the divider. A wheel at the top of divider provides tension to, and helps rotate, a segmented chain. In the exemplary embodiment, the segmented chain is configured to form a substantially solid structure when transitioning between the liquid and gas environments, but separate during vertical travel. As the segmented chain travels between the liquid and gas environments, a rotary motion is created which can be captured as electrical or mechanical energy.

BRIEF DESCRIPTION OF THE DRAWING FIGURES

A more complete understanding of the present invention may be derived by referring to the detailed description and claims when considered in connection with the drawing figures, wherein like reference numbers refer to similar elements throughout the drawing figures, and:

DETAILED DESCRIPTION

Figure 1A:
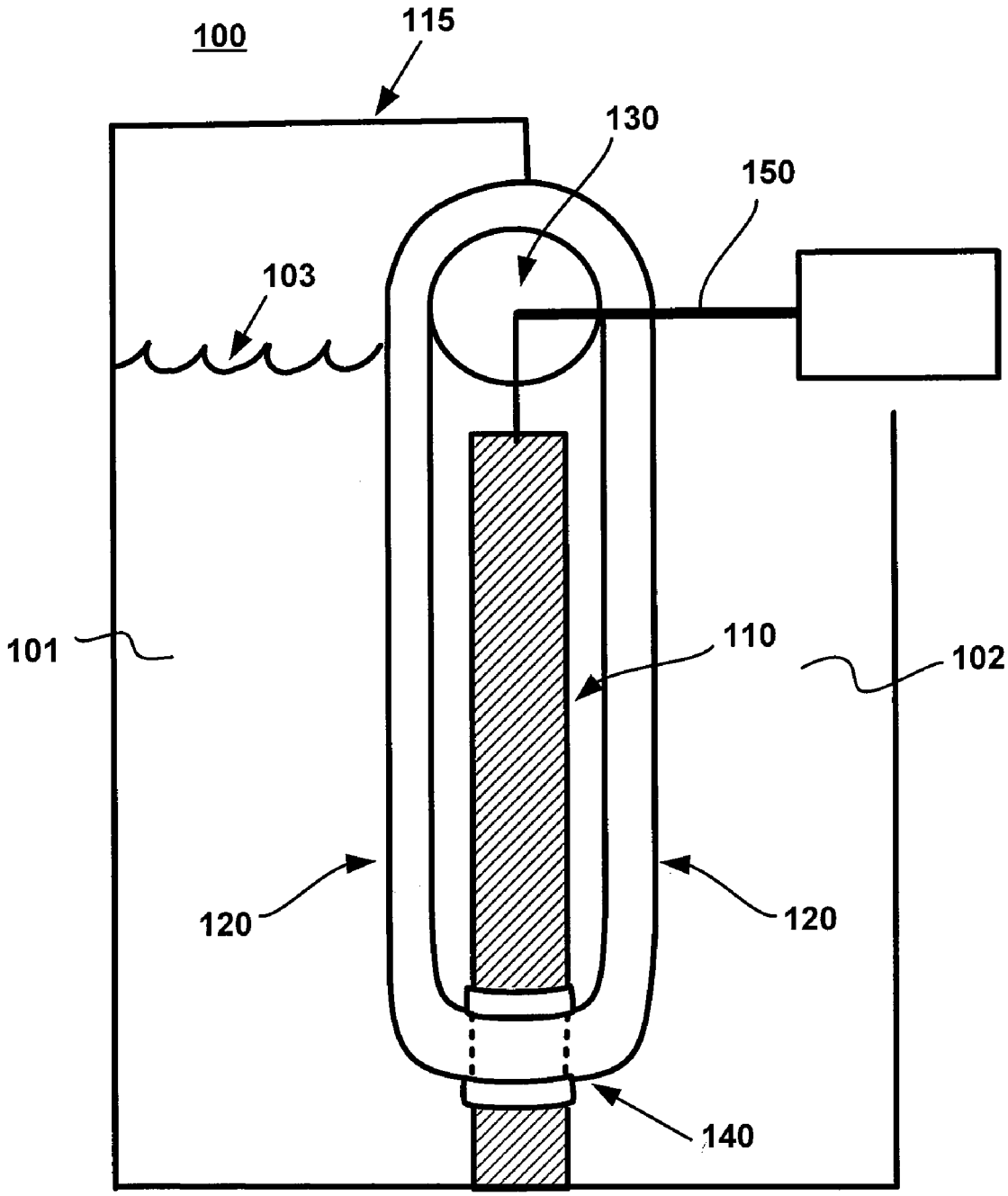
FIGS. 1A-1D illustrate exemplary buoyancy engines.
Figure 1B:
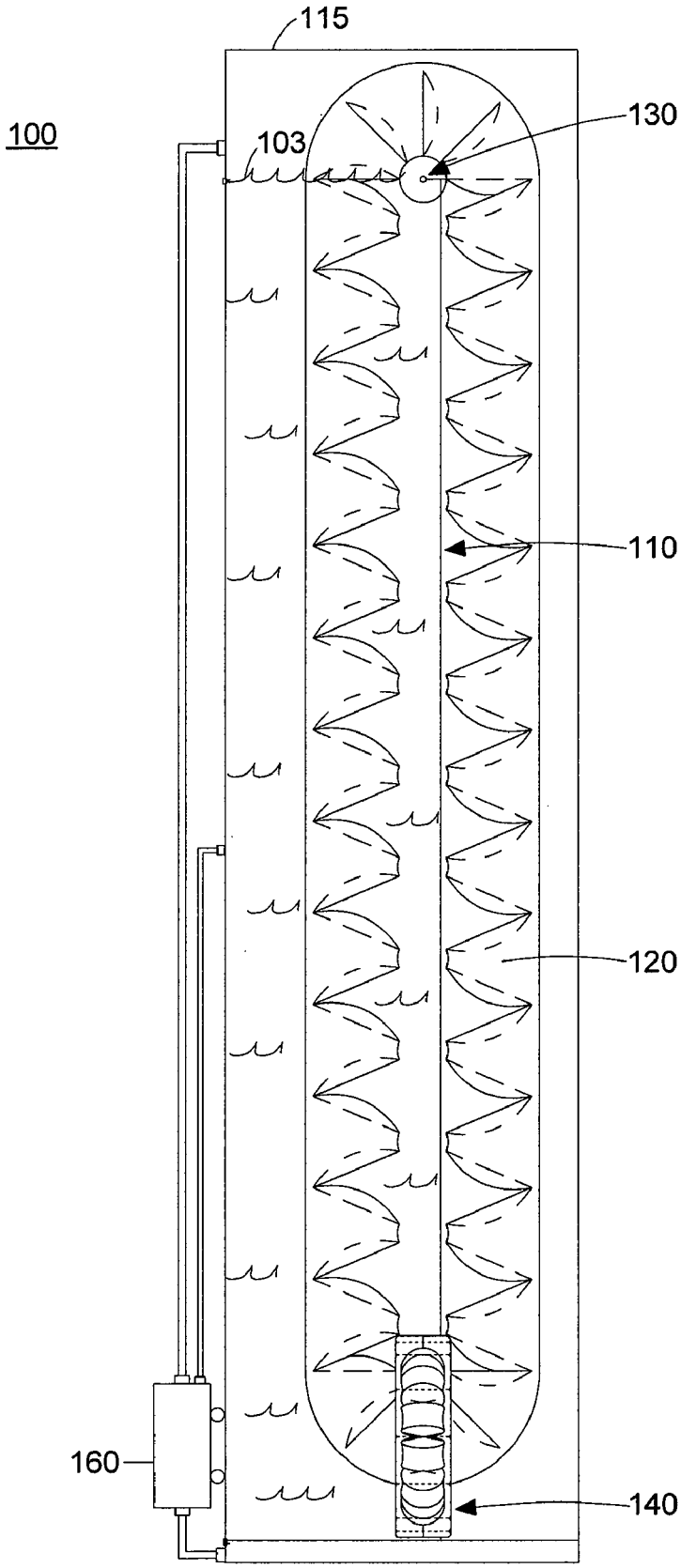

While exemplary embodiments are described herein in sufficient detail to enable those skilled in the art to practice the invention, it should be understood that other embodiments may be realized and that logical, electrical, and mechanical changes may be made without departing from the spirit and scope of the invention. Thus, the following detailed description is presented for purposes of illustration only.

In accordance with an exemplary embodiment and with reference to FIGS. 1A-1D, a buoyancy engine 100 comprises a divider 110 separating a liquid environment from a gas environment, a segmented chain 120, a wheel 130 connected towards the top of divider 110, and a reservoir aperture 140 located towards the bottom of divider 110. In another exemplary embodiment, buoyancy engine 100 may further comprise an output apparatus 150.

In an exemplary embodiment, divider 110 separates the liquid and gas environments and may comprise metal, concrete, plastic, other suitable material now known or hereinafter devised, or any combination of such materials. In accordance with an exemplary embodiment, divider 110 is part of a reservoir 115 that holds a liquid, which is typically water but could be another suitable liquid. In other words, divider 110 may be described as a wall of a holding tank. In further exemplary embodiments, buoyancy engine 100 may be fully enclosed or may be open. Also, buoyancy engine 100 may be thought of as comprising reservoir 115 with divider 110 separating a liquid environment 101 from a gas environment 102. Or the reservoir may be thought of as containing liquid environment 101 and divider 110 is part of an outer wall of reservoir 115.

In the exemplary embodiment, reservoir 115 contains water. However, suitable liquids other than standard water may be used. In exemplary embodiments, suitable liquids include adding agents to change the liquid properties, such as adding saline, silicone, or equivalents to increase buoyancy and/or decrease the temperature of the liquid. Also, alcohol or equivalents could be added to lower the freezing point of the liquid. In one embodiment, a refrigeration or cooler system is attached to reservoir 115 to lower the liquid's temperature. By the same token, a heating system can be used to raise the liquid's temperature to avoid freezing of the liquid.

In an exemplary embodiment, reservoir 115 is generally shaped as a cuboid or cylinder, though other shapes are also contemplated. Reservoir 115 can be either open or closed. Some benefits to closing reservoir 115 include eliminating or decreasing evaporation, noise damping, safety, and ultra-violet light protection. Furthermore, reservoir 115 may be connected to a liquid source that is configured to maintain or adjust the upper liquid level 103. The upper liquid level 103 may change due to evaporation or leakage, such as into gas environment 102. In an exemplary embodiment, the volume of the liquid is at least equal to the displacement volume of the segmented chain. This level of displacement provides a minimal buoyant force.

Furthermore, in an exemplary embodiment and as shown in FIG. 1A, liquid level 103 of liquid environment 101 is about at the bottom edge of wheel 130. In another exemplary embodiment, liquid level 103 is up to the level of liquid environment 101 where segmented chain 120 begins to compress. Moreover, upper liquid level 103 of reservoir 115 may be at any level suitable to provide enough upward force due to buoyancy to generate rotary motion.

Figure 1D:
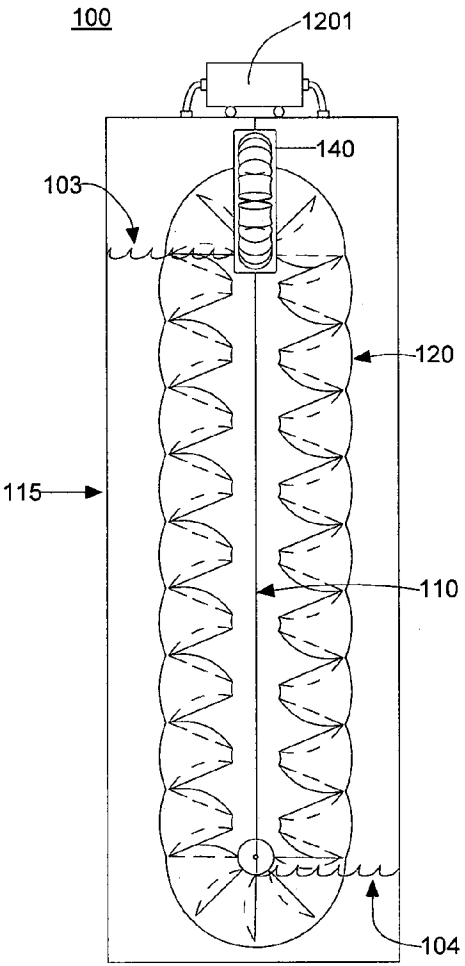
Figure 1C:
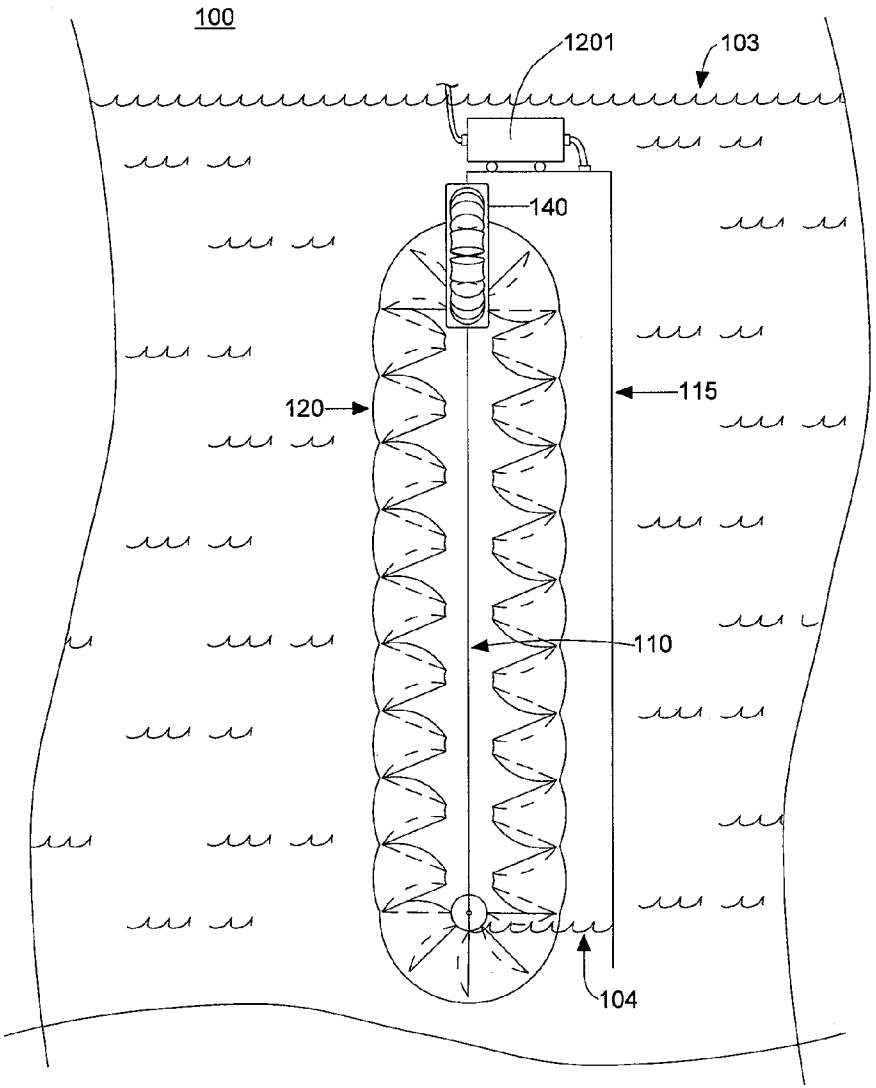
Figure 2:
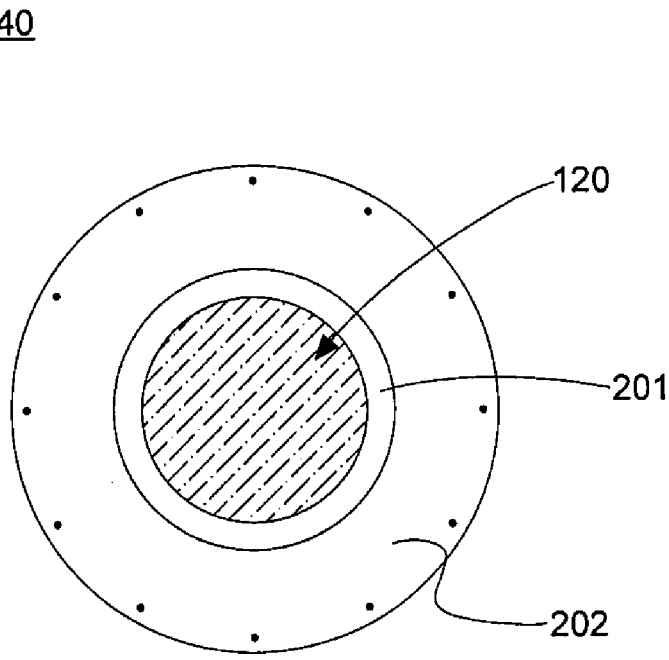
FIG. 2 illustrates an exemplary solid inlet gasket of a reservoir aperture.
Figure 3:
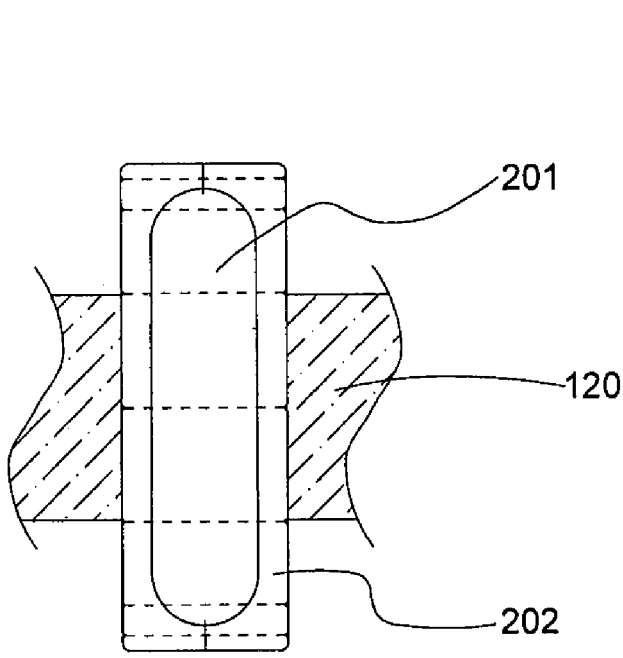
FIG. 3 illustrates a side-view of an exemplary solid inlet gasket of a reservoir aperture.

In an exemplary embodiment and with reference to FIGS. 1C and 1D, a pressure difference is maintained between the liquid and gas environments of buoyancy engine 100. In one embodiment, reservoir aperture 140 is located at the top of buoyancy engine 100 and a pump 1201 maintains the pressure difference by pressuring gas environment 102 and forcing any liquid substantially out of gas environment 102. For example, pressure may be used to create a lower liquid level 104 and a corresponding upper liquid level 103. Maintaining a pressure difference requires that reservoir aperture 140 be configured to keep the pressure differences. In an exemplary embodiment, a control system manages the pressure difference and may include a series of valves and conductivity sensors, floats, or other pressure and level instruments.

The buoyancy engine may be comprised of alternative configurations compared to those already described. The environment of the buoyancy engine may be any variation that maintains a segmented chain producing rotary movement through a liquid environment and a gas environment. Various manners of the overall buoyancy engine have also been contemplated. For example and with reference to FIG. 1C, in a different embodiment, the gas environment is pressurized and placed in a body of liquid, such as an open-water location. The level of liquid is controlled by adjusting the level of the pressurized gas environment within the body of liquid.

FIGS. 2-5 illustrate various embodiments of the reservoir aperture. In an exemplary embodiment, reservoir aperture 140 comprises a material with a low coefficient of friction, such as at least one of UHMW (ultra-high molecular weight) polyethylene, PTFE (polytetrafluoroethene or polytetrafluoroethylene, also known as Teflon®), or other suitable material. Furthermore, reservoir aperture 140 may have a lubricant to decrease friction and add abrasion resistance. Decreasing the friction of reservoir aperture 140 enables more efficient motion of segmented chain 120, and thus more production of energy.

In accordance with an exemplary embodiment, a seal is created where reservoir aperture 140 is in contact with segmented chain 120. For example and with reference to FIGS. 2 and 3, a solid gasket 201 or other similar component may be present in reservoir aperture 140. In an exemplary embodiment, gasket 201 is inside a reservoir aperture housing 202 and has a low coefficient of friction. The gasket 201 may rotate within reservoir aperture 140, thereby creating a seal while still allowing a low friction pass-through for segmented chain 120. In an exemplary embodiment, gasket 201 is an o-ring.

Figure 4:
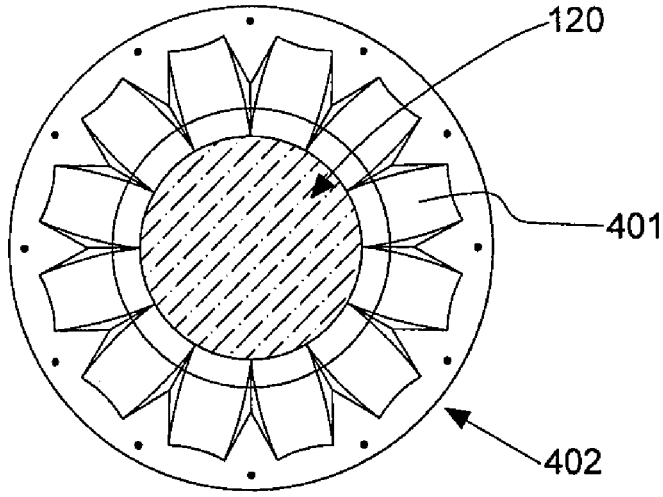
FIG. 4 illustrates an exemplary segmented inlet gasket of a reservoir aperture.
Figure 5:
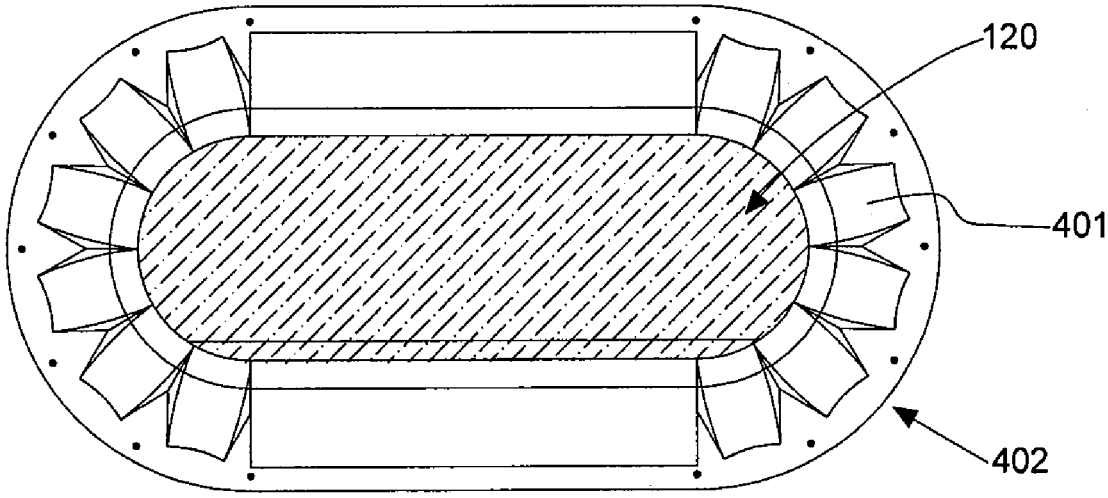
FIG. 5 illustrates another exemplary segmented inlet gasket of a reservoir aperture.

In another exemplary embodiment and with reference to FIGS. 4 and 5, reservoir aperture 140 comprises at least one segmented gasket 401 located inside a reservoir aperture housing 402. In accordance with an exemplary embodiment, reservoir aperture housing 402 includes multiple pieces assembled together and is a part of divider 110. In an exemplary embodiment, reservoir aperture housing 402 is in contact with and at least partially encompasses segmented gasket 401. Furthermore, reservoir aperture housing 402 may be lubricated and be configured to provide a suitable contact surface to facilitate rotation of segmented gasket 401. A portion of segmented gasket 401 that is exposed and not encompassed by reservoir aperture housing 402, in an exemplary embodiment, is in direct contact with segmented chain 120. In accordance with an exemplary embodiment, the contact between reservoir aperture housing 402, segmented gasket 401, and segmented chain generates sufficient pressure to create a seal between the gas and liquid environments, thereby allowing the transition of segmented chain 120.

In an exemplary embodiment, segmented gasket 401 comprises multiple rotating components configured to create a sealed and low-friction pass-through for segmented chain 120. For example, the multiple rotating components may be at least one of rollers, ball-bearings, or other suitable devices for achieving the desired low-friction motion.

Figure 6C:
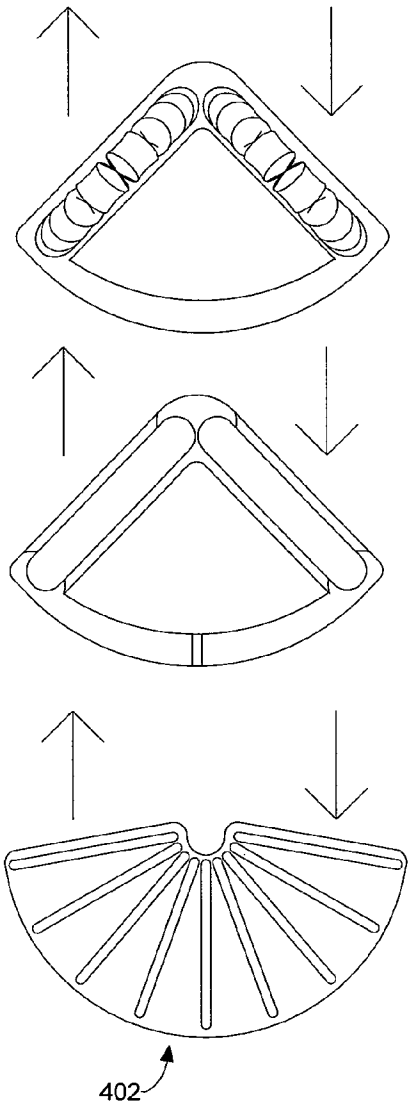
FIGS. 6A-6C illustrate exemplary embodiments of multiple gaskets.
Figure 6B:
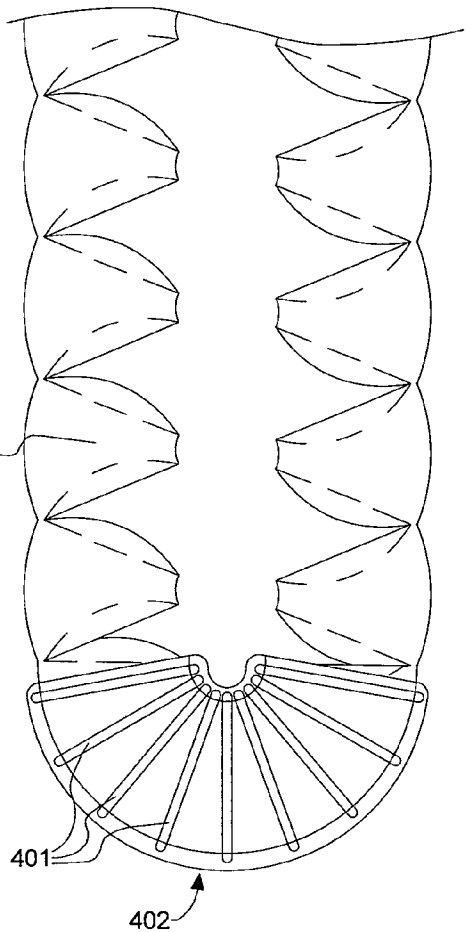
Figure 6A:
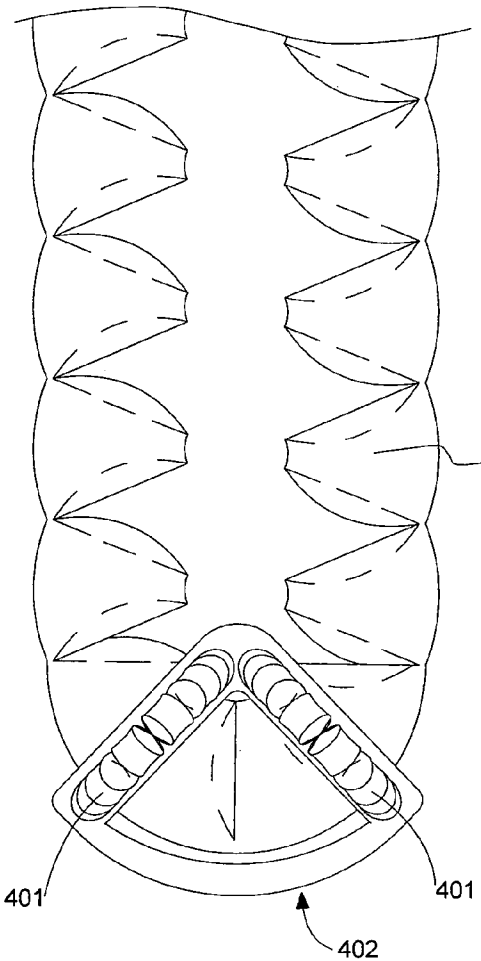

Various configurations of reservoir aperture 140 have been contemplated, including different shapes and multiple rows of segmented gasket 401, and the described embodiments are not meant to be limiting. Furthermore, in exemplary embodiments and with reference to FIGS. 6A-6C, multiple gaskets are present in reservoir aperture 140. Multiple gaskets can provide extra sealing, which is beneficial for a liquid environment with high pressure. In an exemplary embodiment, a minimal number of gaskets are used in reservoir aperture 140 in order to minimize friction while maintaining a substantial seal.

In an exemplary embodiment, wheel 130 is connected to divider 110 of the buoyancy engine 100. The wheel may also be attached to another part of buoyancy engine 100, such as a frame or reservoir wall. In an exemplary embodiment, wheel 130 provides tension to segmented chain 120 and facilitates a substantial frictional grip. For example, wheel 130 may provide tension by implementing springs, hydraulics, or similar devices configured to provide adjustable, continuous tension to segmented chain 120. In addition to a wheel, in an exemplary embodiment, segmented chain may traverse at least one gasket within a housing, similar to reservoir aperture 140. In yet another embodiment, a surface with a low-coefficient of friction is present between the liquid and gas environments.

Output apparatus 150 may be connected to, or near, any of the moving parts of buoyancy engine 120. In an exemplary embodiment, output apparatus 150 is connected to at least one of wheel 130 or reservoir aperture 140. In accordance with an exemplary embodiment, output apparatus 150 may generate mechanical energy by implementing a shaft, such as a crankshaft. Use of a crankshaft is well known in the art and will not be discussed in detail herein. In another exemplary embodiment, output apparatus 150 may generate electrical energy by implementing magnets, stators, or other suitable means as now know or hereinafter devised.

As mentioned above, in an exemplary embodiment, segmented chain 120 is attached around wheel 130 and through reservoir aperture 140, which provides tension. Segmented chain 120 is able to transition between the gas environment and the liquid environment with substantially little friction while maintaining a division between the two environments. In an exemplary embodiment, segmented chain 120 is buoyant in the liquid environment, resulting in an upward force. In contrast, segmented chain 120 is subject to a gravitational downward force when segmented chain 120 is in the gas environment. The resulting upward and downward forces combine to generate a rotary motion of segmented chain 120. In an exemplary embodiment, segmented chain 120 moves along a set path such that a portion of the set path consists of vertical travel through the liquid environment on one side of divider 110 and continues down the other side of divider 110.

Figure 7:
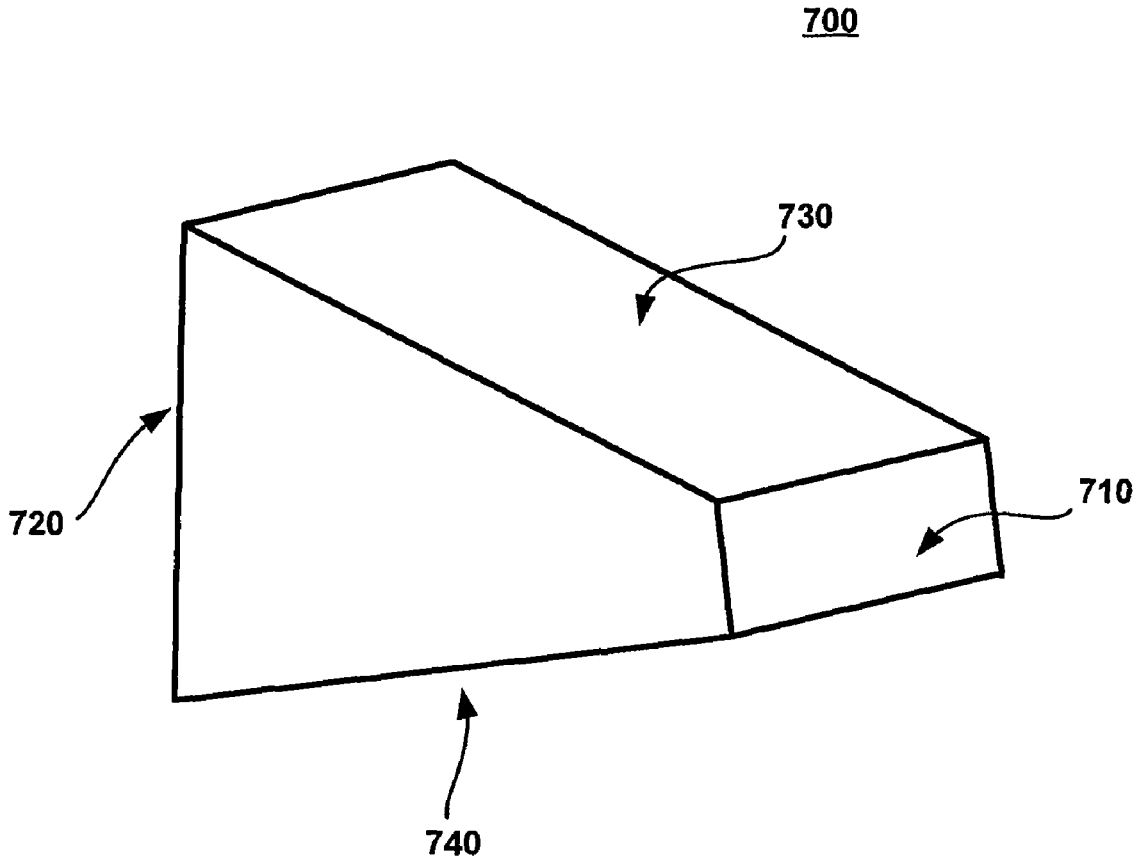
FIG. 7 illustrates a perspective view of an exemplary segment of a segmented chain.
Figure 8A:
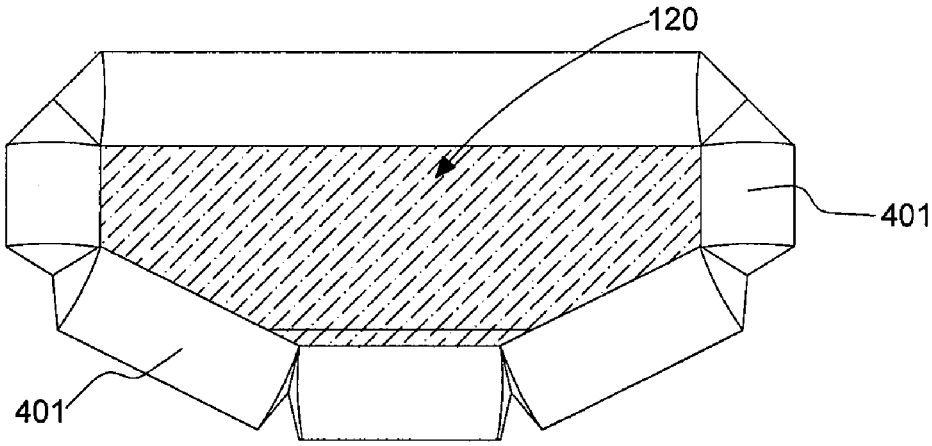
FIGS. 8A-8G illustrate various embodiments of a reservoir aperture.
Figure 8B:
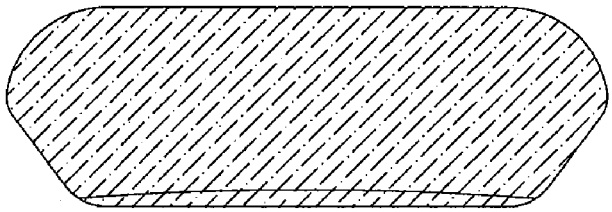
Figure 8C:
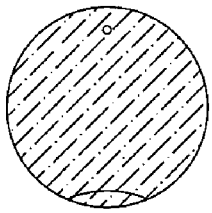
Figure 8D:
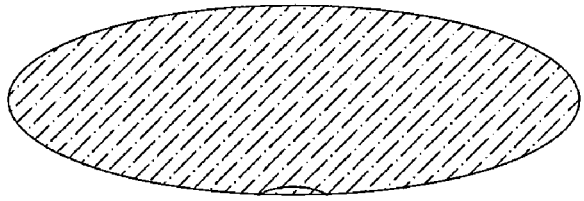
Figure 8E:
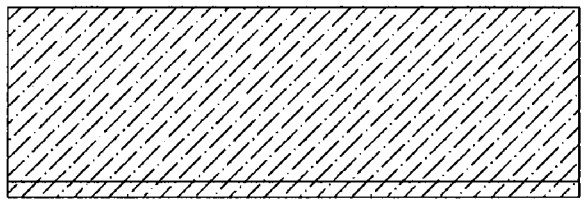
Figure 8F:
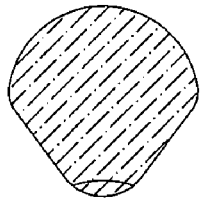
Figure 8G:
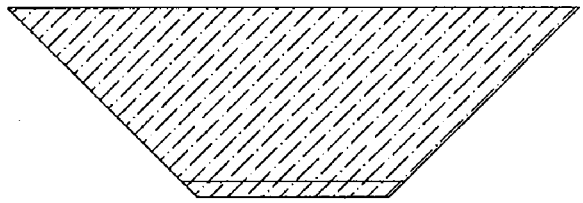

For purposes of illustration and with reference to FIG. 7, a segment 700 of segmented chain 120 is described as comprising an inner surface 710, an outer surface 720, a leading surface 730, and a trailing surface 740. In an exemplary embodiment, segment 700 may comprise various shapes, as illustrated by various leading surface viewpoints in FIGS. 8A-8G. For example, leading surface 730 and trailing surface 740 may be in the shape of at least one of a circle (8C), oval, ellipse, rounded rectangle (8D), rectangle (8E), or trapezoid (8G). From the side viewpoint, segment 700 may be a trapezoid, triangle, or other shape such that outer surface 720 of the segment is larger than inner surface 710. Furthermore, the edge formed by outer surface 720 and either leading surface 730 or trailing surface 740 connects to a corresponding edge of the next segment in segmented chain 120. The connection of segments and alignment of outer surfaces 720 forms an outer circumference of segmented chain 120. Furthermore, in an exemplary embodiment, the area of leading surface 730 is substantially equivalent to area of reservoir aperture 140. Therefore, in the exemplary embodiment, a seal is formed between segmented chain 120 and reservoir aperture 140 without undue friction.

With reference to FIGS. 9A-9D, in an exemplary embodiment, segmented chain 120 comprises a plurality of segments that are configured to separate during vertical travel and compress during passage when transitioning between the liquid environment and the gas environment. In word others, when the segmented chain 120 travels either around wheel 130 or through reservoir aperture 140, the inner surfaces of the segments connect and form a substantially solid structure.

Figure 9B:
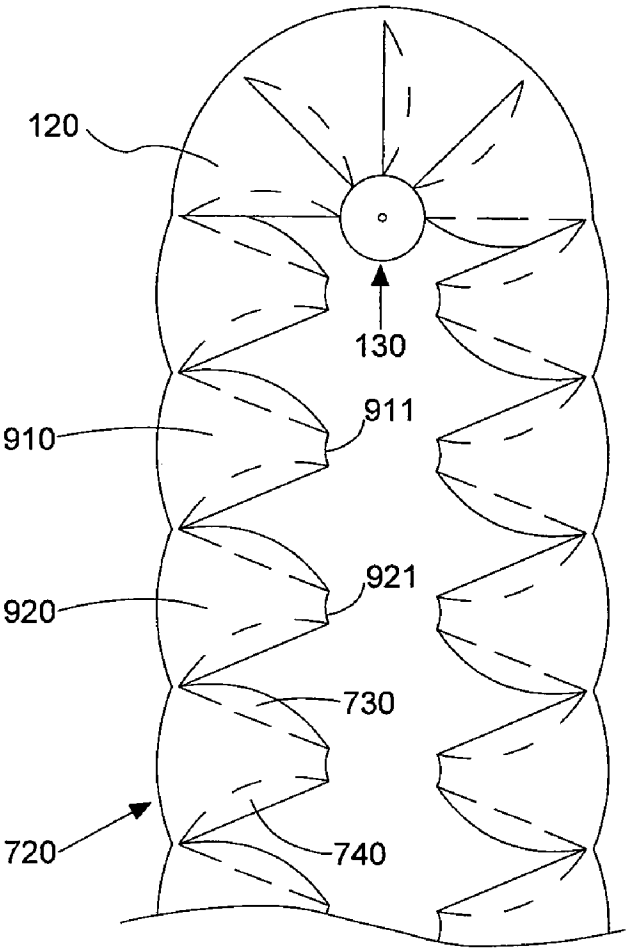
FIGS. 9A-9D illustrate side-views of various exemplary segmented chains.
Figure 9A:
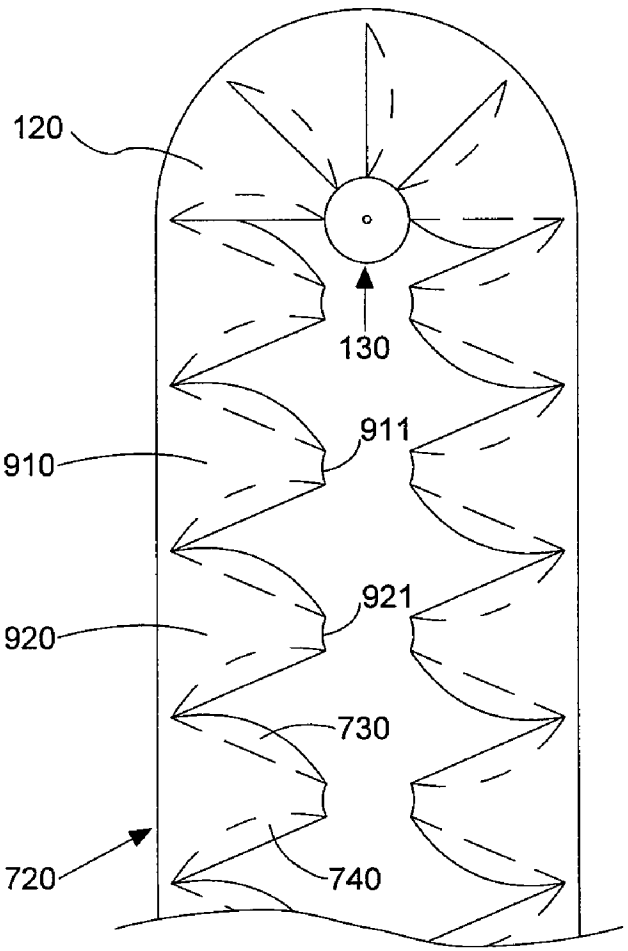
Figure 9D:
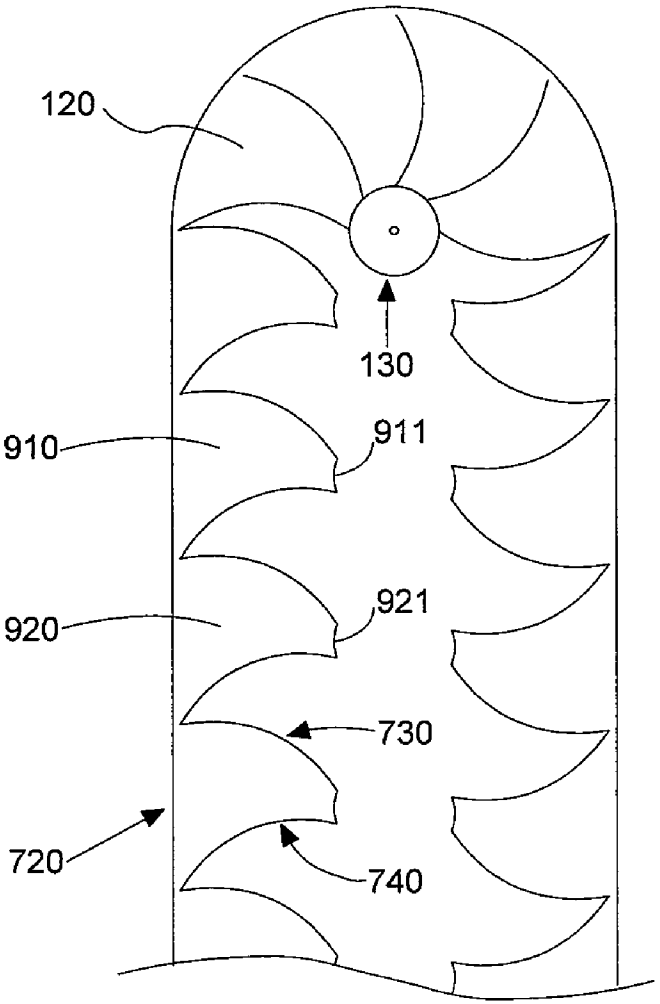
Figure 9C:
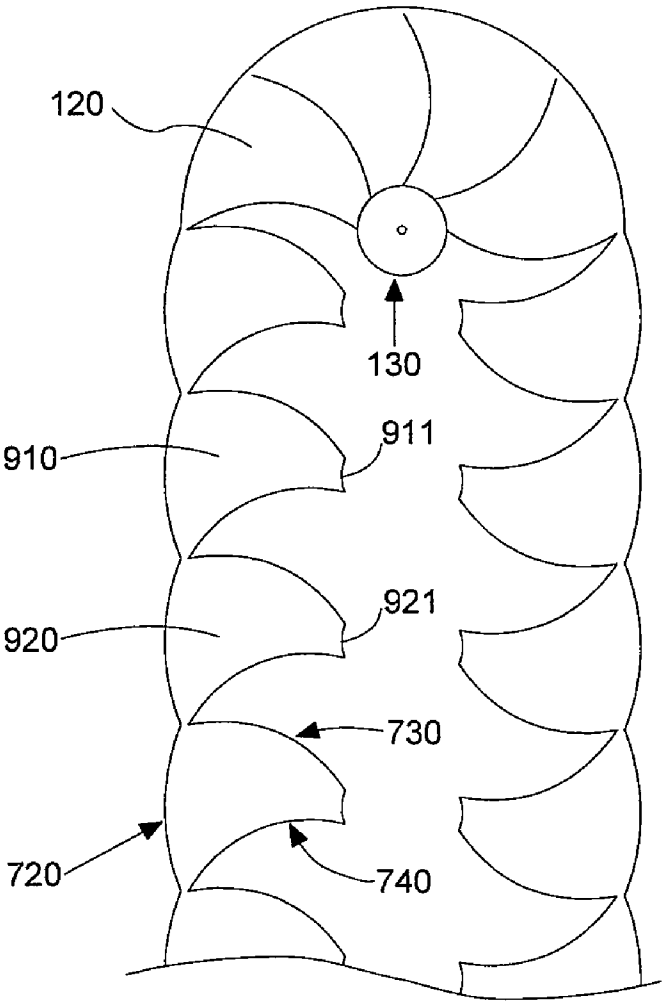

In accordance with an exemplary embodiment, the leading surface of a segment comprises a convex shape and the trailing surface comprises a concave shape configured to increase the sealing ability of the segmented chain 120. As illustrated in FIG. 9A, a segment may have a bowed leading surface 730 and a corresponding bowed matching relief on a trailing surface 740, where bowed leading surface 730 and relief trailing surface 740 are designed such that two segments of segmented chain 120 fit together to form a seal when transitioning between the reservoir and the liquid chamber. As illustrated in FIGS. 9A and 9B, the convex and concave shapes may comprise a cupped surface. FIGS. 9C and 9B illustrate exemplary embodiments of a curved leading surface 730 and a curved trailing surface 740 that are not cupped, but instead have curved outer edges. The convex and concave shapes are designed to increase the hydrodynamic performance of segmented chain 120. In one embodiment, the curved surfaces increase the ability to seal of the segments and facilitate alignment of the segments when compressing. In another embodiment, the curved surfaces are configured to increase the hydrodynamic performance of segmented chain 120. This is accomplished by increasing, in comparison to a flat trapezoidal segment, the surface area of the segment that is substantially perpendicular to the direction of vertical travel. In addition and with reference to FIG. 9A, the turning radius of the segmented chain 120 is determined by the distance between the inner surface 911 of a first segment 910 and the inner surface 921 of a connected second segment 920. The farther apart the inner surfaces of two linked segments, the tighter the turning radius of segmented chain 120.

Figure 10A:
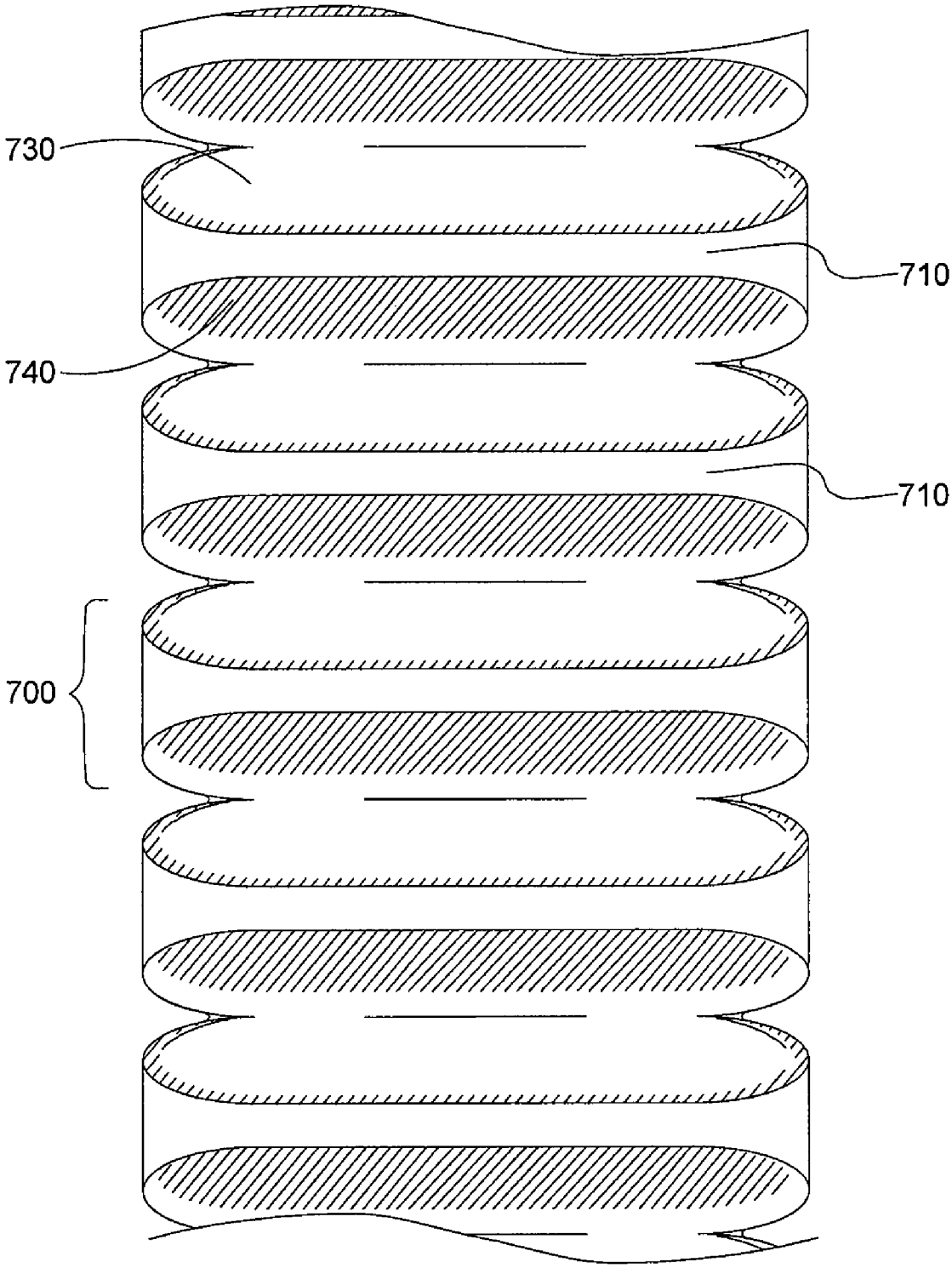
FIGS. 10A-10B illustrate multiple views of an exemplary segmented chain.
Figure 10B:
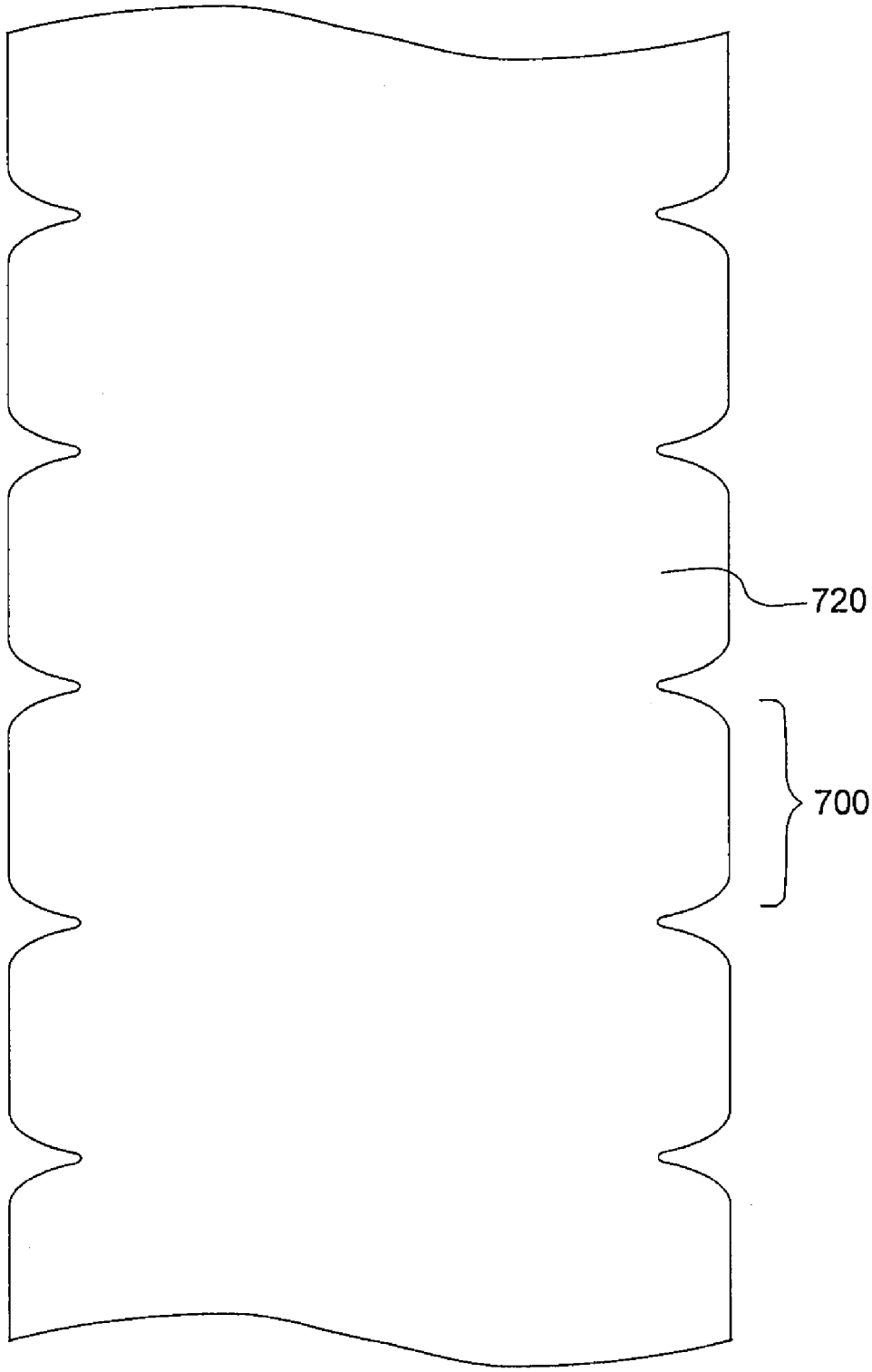
Figure 11A:
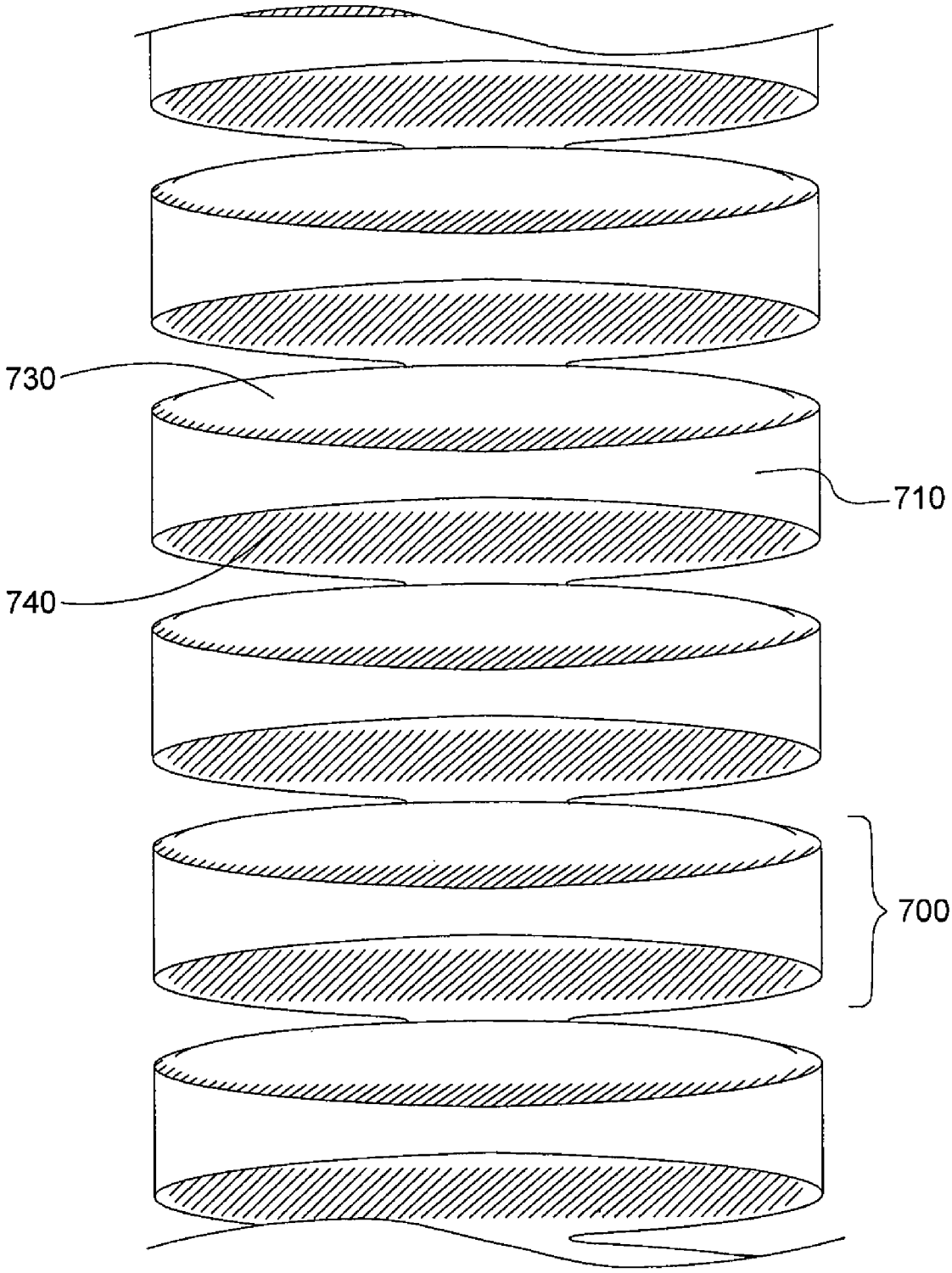
FIGS. 11A-11C illustrate exemplary embodiments of attached segments.
Figure 11B:
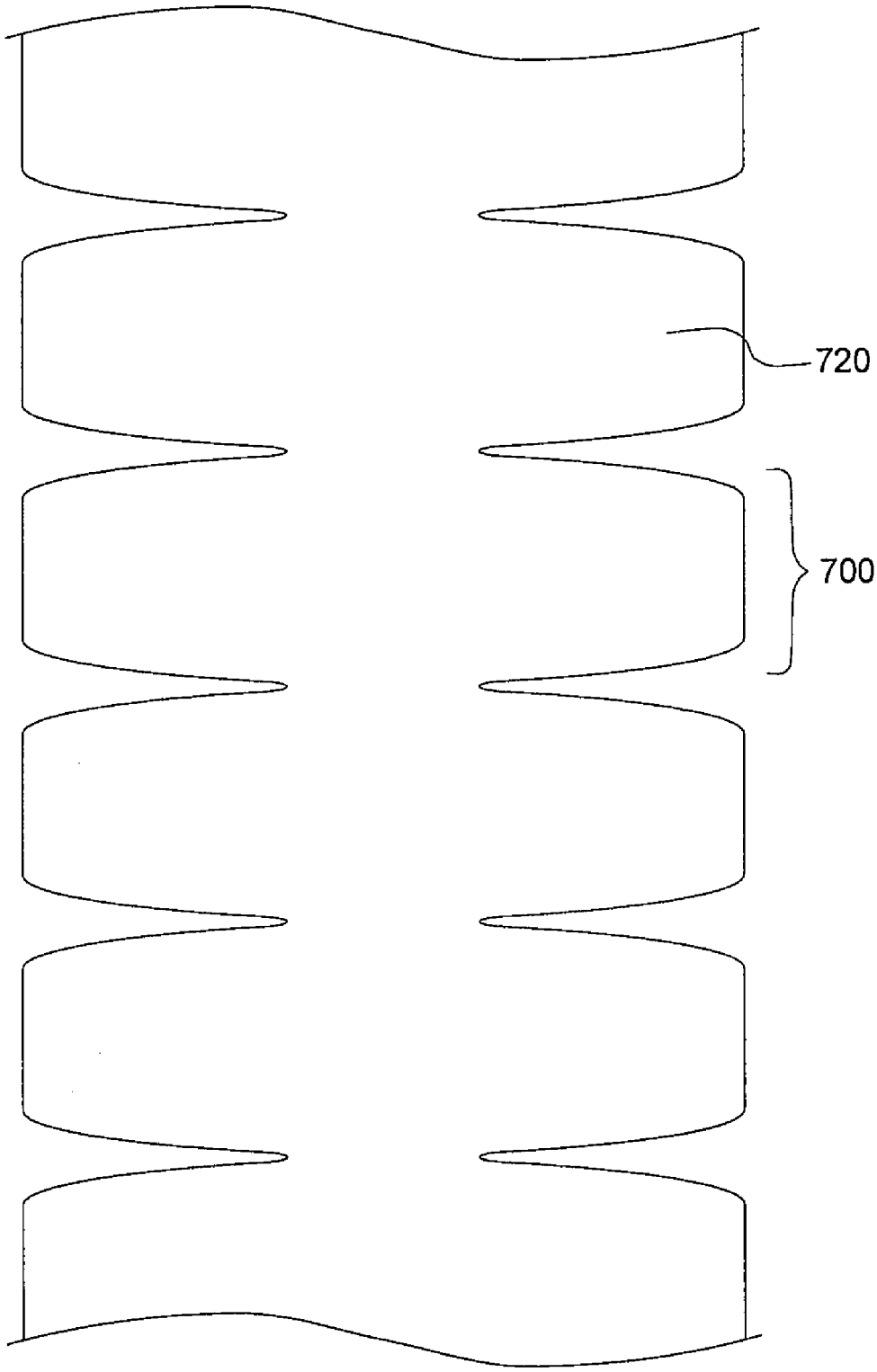
Figure 11C:
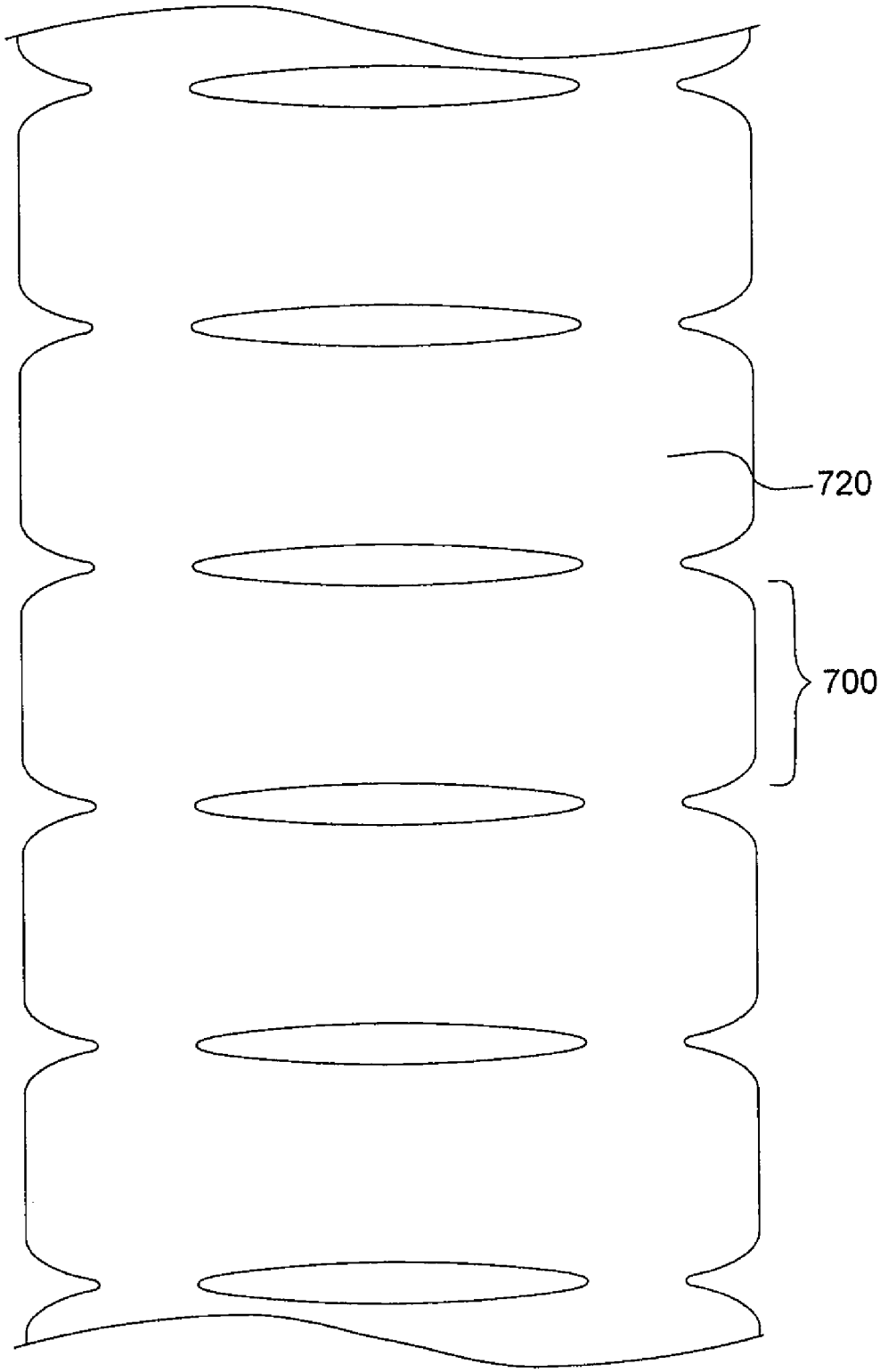

Furthermore, segmented chain 120 may be made from various materials, including at least one of wood, fiberglass, metal, carbon fiber, foam, plastic (specifically polypropylene or polyethylene), rubber (natural or synthetic) or other suitable materials as would be known to one skilled in the art. Also, the segments may comprise some material with a cover that provides additional rigidity. In another embodiment, the segments comprise a rigid or solid core and a softer outer surface. For example, the outer surface may be foam or laminate material. The segment may comprise any combination of materials so long as the segment is lighter in a liquid than in a gas environment. Furthermore, in an exemplary embodiment, segmented chain 120 comprises flexible foam composite with a continuous metal chain through the middle of the foam composite. In another embodiment, the metal chain is replaced with at least one of a cable, a roller chain, a spring metal band, cross-linked fibers, or a plastic infrastructure. In yet another exemplary embodiment and with reference to FIGS. 10A and 10B, segmented chain 120 does not comprise a continuous chain, but instead comprises individual segments that are connected at the outer surface. In an exemplary embodiment and with reference to FIGS. 11A-11C, the segments may be connected at a single point or at multiple points along the outer surface edge of segmented chain 120. The segments may be hinged, sewn, glued, fused, or other suitable means of attachment as now known or hereinafter devised. In yet another exemplary embodiment, segmented chain 120 is comprised of one solid or continuous piece of material, such as molded foam for example.

Since some liquid will end up in the gas environment in actual operation, various means may be implemented to maintain as much separation as possible. In an exemplary embodiment, excess liquid is collected from segmented chain 120 when exiting the liquid environment. For example, at least one of brushes, an additional sealed inlet, a rubber/neoprene wiper, a hydrophobic skin on a structure such as the segmented chain or reservoir aperture, or other suitable devices may be included in buoyancy engine 100. Furthermore, in an exemplary embodiment, liquid that is present in the gas environment is collected and transferred back to the liquid environment. For example and with reference to FIG. 1B, a pump 160 could transfer the liquid that collects in a drain in buoyancy engine 100. The conservation of liquid helps to enable a stand-alone buoyancy engine 100 that requires little to no maintenance.

In an exemplary embodiment, the buoyancy engine is not limited in size and the energy produced by buoyancy engine 100 is directly related to the volume of segmented chain 120. In other words, an increase in the liquid displaced by segmented chain 120 results in more power generated. In an exemplary embodiment, the buoyant forces are equal or substantially equal to the gravitational forces. In an exemplary embodiment, this enables the center of gravity of buoyancy engine 120 to be located in the center, and thus less wear on the engine during operation. In another exemplary embodiment, the angular momentum generated via rotary motion is centered and reaches an equilibrium, which facilitates less wear on buoyancy engine 120. Furthermore, in another exemplary embodiment the overall energy production is increased by operating multiple segmented chains in same liquid environment.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as critical, required, or essential features or elements of any or all the claims. As used herein, the terms "includes," "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. Further, no element described herein is required for the practice of the invention unless expressly described as "essential" or "critical."

What is claimed is:

1. A buoyancy engine comprising:

a divider comprising a top and a bottom and configured to separate a liquid environment from a gas environment;

a reservoir aperture located in said divider;

a rotational device connected to said divider;

a segmented chain comprising a plurality of linear segments, wherein said plurality of linear segments individually comprise an inner surface, an outer surface, a leading surface and a trailing surface, wherein said leading surface comprises a convex shape and wherein said trailing surface comprises a substantially mirrored concave shape, wherein said segmented chain rotates about said reservoir aperture and said rotational device;

wherein said segmented chain is configured to separate during linear vertical travel; and wherein a trailing surface of a first segment of said plurality of segments is configured to compress with a leading surface of second segment of plurality of segments to form said substantially solid surface in response to transitioning through said reservoir aperture, wherein said first segment is adjacent to said second segment in said segmented chain.

2. The buoyancy engine of claim 1, wherein said reservoir aperture comprises a segmented gasket located about the perimeter of said reservoir aperture.

3. The buoyancy engine of claim 2, wherein said segmented gasket comprises at least one a plurality of rotatable segments, rollers, or ball-bearings.

4. The buoyancy engine of claim 1, wherein said reservoir aperture comprises a solid gasket located about the perimeter of said reservoir aperture, wherein said solid gasket is configured to create a seal between said segmented chain and said reservoir aperture.

5. The buoyancy engine of claim 1, wherein said segmented chain is configured to create sufficient segment-to-segment contact such that substantially no liquid passes from the liquid environment to the gas environment.

6. The buoyancy engine of claim 1, further comprising a plurality of segmented chains operating about said divider.

7. The buoyancy engine of claim 1, wherein said segmented chain generates rotary motion about said divider due to an upward buoyant force in said liquid environment and a downward gravitational force in said gas environment.

8. The buoyancy engine of claim 1, wherein said rotational device is a second reservoir aperture.

9. A segmented chain in a buoyancy engine, said segmented chain comprising:

a plurality of segments, wherein said plurality of segments individually comprise an inner surface, an outer surface, a leading surface and a trailing surface, wherein said leading surface comprises a convex shape and wherein said trailing surface comprises a substantially mirrored concave shape;

wherein said plurality of segments are linearly connected along the outer surface;

wherein said segmented chain passes through a reservoir aperture of a reservoir, and wherein a trailing surface of a first segment of said plurality of segments is configured to compress with a leading surface of second segment of plurality of segments to form a substantially solid structure in response to transitioning between a liquid environment and a gas environment, wherein said first segment is adjacent to said second segment in said segmented chain.

10. The segmented chain of claim 9, wherein said plurality of segments is configured to separate in response to said segmented chain travels in an approximately linear path.

11. The segmented chain of claim 9, wherein said segmented chain comprises at least one of fiberglass, wood, foam, metal, carbon fiber, plastic, or rubber.

12. The segmented chain of claim 9, wherein said segmented chain comprises a foam composite material encasing at least one of a continuous chain or continuous cable.

13. A method comprising:

generating a rotary motion using a segmented chain in a buoyancy engine, wherein said segmented chain comprises a plurality of segments, wherein said plurality of segments individually comprise an inner surface, an outer surface, a leading surface and a trailing surface, wherein said leading surface comprises a convex shape and wherein said trailing surface comprises a substantially mirrored concave shape;

designing said plurality of segments to separate during linear travel;

designing said plurality of segments to form a substantially solid surface in response to said segmented chain is transitioning between a liquid environment and a gas environment;

transitioning said segmented chain through a reservoir aperture, wherein a trailing surface of a first segment of said plurality of segments is configured to compress with a leading surface of second segment of plurality of segments to form said substantially solid surface in response to transitioning between the liquid environment and the gas environment, wherein said first segment is adjacent to said second segment in said segmented chain; and wherein said rotary motion comprises an upward buoyant force in said liquid environment and a downward gravitational force in said gas environment.

14. The method of claim 13, further comprising producing mechanical energy using a wheel configured to rotate during operation of said buoyancy engine.

15. The method of claim 13, further comprising producing electrical energy using at least one of magnets or stators.

16. The method of claim 13, wherein said reservoir aperture comprises at least one of polyethylene, polytetrafluoroethene, or polytetrafluoroethylene.

17. The method of claim 13, further comprising facilitating the transitioning said segmented chain through said reservoir aperture using a rotatable gasket.

* * * * *